US010667596B2

(12) United States Patent
Da Silva et al.

(10) Patent No.: US 10,667,596 B2
(45) Date of Patent: Jun. 2, 2020

(54) TOPICAL PREPARATION WARMING DEVICE

(71) Applicant: Johnson & Johnson Consumer Inc., Skillman, NJ (US)

(72) Inventors: Jorge Da Silva, Skillman, NJ (US); Ronald J. Gillespie, Skillman, NJ (US); Alexandru Paunescu, Skillman, NJ (US)

(73) Assignee: Johnson & Johnson Consumer Inc., Skillman, NJ (US)

( * ) Notice: Subject to any disclaimer, the term of this patent is extended or adjusted under 35 U.S.C. 154(b) by 319 days.

(21) Appl. No.: 15/467,637

(22) Filed: Mar. 23, 2017

(65) Prior Publication Data

US 2017/0280858 A1 Oct. 5, 2017

Related U.S. Application Data

(60) Provisional application No. 62/314,706, filed on Mar. 29, 2016.

(51) Int. Cl.
*A45D 44/00* (2006.01)
*A45D 40/26* (2006.01)
(Continued)

(52) U.S. Cl.
CPC ..... *A45D 44/00* (2013.01); *A45D 40/26* (2013.01); *B65D 25/20* (2013.01); *H05B 3/06* (2013.01);
(Continued)

(58) Field of Classification Search
CPC ..... A45D 44/00; A45D 2200/15; A45D 2200/155; A45D 2200/157; A45D 2200/20; A45D 33/04; A45D 33/16; A45D 33/22; A45D 33/32; A45D 33/25; A45D 40/26; A45D 40/264; A45D 40/265; A45D 2040/225; A45D 2040/227; A45D 2040/228; A45D 2040/224; B65D 25/20; H05B 3/06; H05B 3/42; H05B 3/68; H05B 3/0052; H05B 3/0085; H05B 3/009; H05B 2203/016; H05B 2203/021; H05B 1/025; B05C 17/001; B05C 17/00523; B05C 17/00546; A01M 1/2044; A01M 1/2061; A01M 1/2077; A01M 1/2033; A61L 9/00; A61L 9/02; A61L 9/03; A61L 9/037;
(Continued)

(56) References Cited

U.S. PATENT DOCUMENTS 1,485,193 A 2/1924 Andrew
5,628,641 A 5/1997 Hahn
(Continued)

FOREIGN PATENT DOCUMENTS

EP 2074906 A 7/2009
WO WO 2009/143334 A 11/2009

OTHER PUBLICATIONS

International search report and written opinion dated Jul. 27, 2017, for international application PCT/US2017/024672.

*Primary Examiner* — Shawntina T Fuqua

(57) ABSTRACT

The present invention relates to devices that pre-warm topical preparation intended for application to skin. Specifically, the present invention relates to devices that pre-warm a premeasured amount of a topical preparation from a larger source without warming the full source.

11 Claims, 3 Drawing Sheets

(51) Int. Cl.

| | |
|---|---|
| ***H05B 3/42*** | (2006.01) |
| ***B65D 25/20*** | (2006.01) |
| ***H05B 3/06*** | (2006.01) |
| *B05C 17/00* | (2006.01) |

(52) U.S. Cl.
CPC ..... *H05B 3/42* (2013.01); *A45D 2200/155* (2013.01); *B05C 17/001* (2013.01); *H05B 2203/016* (2013.01); *H05B 2203/021* (2013.01)

(58) Field of Classification Search
CPC .. A61L 9/12; A61L 9/127; A61L 9/122; A47J 36/2486; A47J 36/26; A47J 36/2411; A47J 36/2444; A47J 36/24; A47J 36/34; A47J 37/0623; A47J 37/0709; A47J 37/006
See application file for complete search history.

(56) References Cited

U.S. PATENT DOCUMENTS

| | | | | |
|---|---|---|---|---|
| 5,775,344 | A | 7/1998 | Clay | |
| 5,856,653 | A | 1/1999 | Boudreaux | |
| 6,362,460 | B1 | 3/2002 | Fraker | |
| 6,870,137 | B1 | 3/2005 | Clapp | |
| 7,108,438 | B2 | 9/2006 | Fontaine | |
| 7,753,609 | B2 | 7/2010 | Bouix et al. | |
| 7,910,860 | B2 | 3/2011 | Irvin | |
| 7,938,128 | B2 | 5/2011 | Gueret | |
| 7,950,863 | B2 | 5/2011 | Bouix et al. | |
| 8,104,982 | B2 | 1/2012 | Duru | |
| 2008/0056691 | A1* | 3/2008 | Wingo ..... | A01M 1/2033 392/395 |
| 2009/0038685 | A1 | 2/2009 | Hill et al. | |
| 2009/0118684 | A1 | 5/2009 | Da Silva et al. | |
| 2009/0162128 | A1 | 6/2009 | Duru | |
| 2010/0217357 | A1 | 8/2010 | Da Silva et al. | |
| 2013/0105595 | A1* | 5/2013 | Richard ..... | H01R 39/64 239/135 |

* cited by examiner

TOPICAL PREPARATION WARMING DEVICE

CROSS-REFERENCE TO RELATED APPLICATIONS

This application claims the benefit to U.S. application Ser. No. 62/314706 filed on Mar. 29, 2016.

FIELD OF THE INVENTION

The present invention relates to devices that pre-warm topical preparation intended for application to skin. Specifically, the present invention relates to devices that pre-warm a premeasured amount of a topical preparation from a larger source without warming the full source.

BACKGROUND OF THE INVENTION

There are many topical preparations intended for application to unbroken skin. They may be in the form of low- to medium-viscosity lotions or oils, or higher viscosity creams or gels. The topical preparations are applied to external skin with bare hands, a clean cloth, cotton wool or gauze. They are used for all age groups, from newborns to the aging and aged demographic groups.

The therapeutic benefits that come from applying warm topical preparations are numerous. Generally, the preparations that come directly from their containers are cold or cool relative to the skin.

There are many known devices that act as warmers to keep topical preparations at desired warmth. In general, the container with the topical preparation is placed in the device, and the device warms the entire container and the topical preparation contained within. These devices are often sized so as to warm multiple containers with topical preparations.

One limitation of these devices is that they warm the entire contents of the container. If the consumer desires to warm only a portion of the container, they must wait for the entire contents to be warmed before use. Also, there is a waste of energy if the entire contents are warmed and only a small portion of the container is used. In addition, if the consumer plans to use the topical preparations intermittently, then consumer must either keep the container continually in the warming device (wasting energy), or spend time waiting for the entire contents of the container to re-warm each time they wish to use a warm preparation. In some cases, the repeated heating and cooling of the topical preparation results in the degradation of the lotion by chemical (such as oxidation) or physical (such as phase separation).

Topical preparations for application to skin are used by all age groups. Often, warming of the lotions is desired before application. There is a desire to have devices that pre-warm a premeasured amount of a topical preparation from a larger source without warming the full source.

SUMMARY OF THE INVENTION

The present invention relates to devices that pre-warm a premeasured amount of a topical preparation from a larger source without warming the full source.

In one embodiment of the invention, a warming device includes a housing having a receptacle formed therein terminating in a bottom surface orifice, heating elements disposed within the housing and substantially surrounding the receptacle, an electrical connection, and a bottom surface orifice cover. The housing has a top surface, a bottom surface, a first side extending from the top surface to the bottom surface. The receptacle extends from a top surface orifice to a bottom surface orifice. The electrical connection in the form of a pair of prongs is associated with the first side surface for selective coupling to an external electrical power source, the electrical connection is pivotable between a first position extending substantially perpendicular from the first side for insertion into an electrical socket and a second position, substantially parallel to the first side. The bottom surface orifice cover is mechanically connected to the electrical connection and is movable between a first position, corresponding to the first position of the electrical connection and occluding the bottom surface orifice and a second position, corresponding to the second position of the electrical connection. In the second position, the cover is displaced from the bottom surface orifice.

In another embodiment of the invention, a kit includes the warming device described above and a container. The container includes a main body comprising a reservoir for a topical preparation and a dispensing tip arranged and configured for engaging the receptacle.

In yet another embodiment, a method of heating a topical preparation employs the kit described above. The method includes the steps of inserting the dispensing tip of the container into the receptacle, inserting the electrical connection into an external electrical power source to warm the topical preparation associated with the dispensing tip of the container, removing the electrical connection from the electrical socket and pivoting the electrical connection to the second position, and dispensing a desired amount of warmed topical preparation from the dispensing tip of the container. As the electrical connection is pivoted from the first to the second position, the cover moves from a position occluding the bottom surface orifice to a second position, displaced from the bottom surface orifice to permit the topical preparation to be dispensed.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

DETAILED DESCRIPTION OF THE INVENTION

Many topical preparations, especially those intended for use on the hands, feet and body, are formulated not as a medicine delivery system, but simply to smooth, re-hydrate, and soften the skin, or to apply inert ingredients for uses such as sunscreens. These are particularly popular with very young, as well as with the aging and aged demographic groups. In the case of face usage, these preparations can also be classified as a cosmetic, and may contain fragrances.

They may be in the form of low- to medium-viscosity lotions or oils, or higher viscosity creams or gels.

Most lotions are oil-in-water emulsions using a substance such as cetearyl alcohol to keep the emulsion together, but water-in-oil lotions are also formulated. The key components of a skin care lotion, cream or gel emulsion (that is mixtures of oil and water) are the aqueous and oily phases, an emulgent to prevent separation of these two phases, and, if used, the drug substance or substances. A wide variety of other ingredients such as fragrances, glycerol, petroleum jelly, dyes, preservatives, proteins and stabilizing agents are commonly added to lotions. Lotions can be used for the delivery to the skin of active ingredients such as antibiotics, antiseptics, antifungals, corticosteroids, anti-acne agents, and soothing, smoothing, moisturizing or protective agents (such as calamine).

It is not unusual for the same drug ingredient to be formulated into a lotion, cream and ointment. Creams are the most convenient of the three but are inappropriate for application to regions of hairy skin such as the scalp, while a lotion is less viscous and may be readily applied to these areas (many medicated shampoos are in fact lotions). Historically, lotions also had an advantage in that they may be spread thinly compared to a cream or ointment and may economically cover a large area of skin, but product research has steadily eroded this distinction. Non-comedogenic lotions are recommended for use on acne prone skin.

Figure 1:
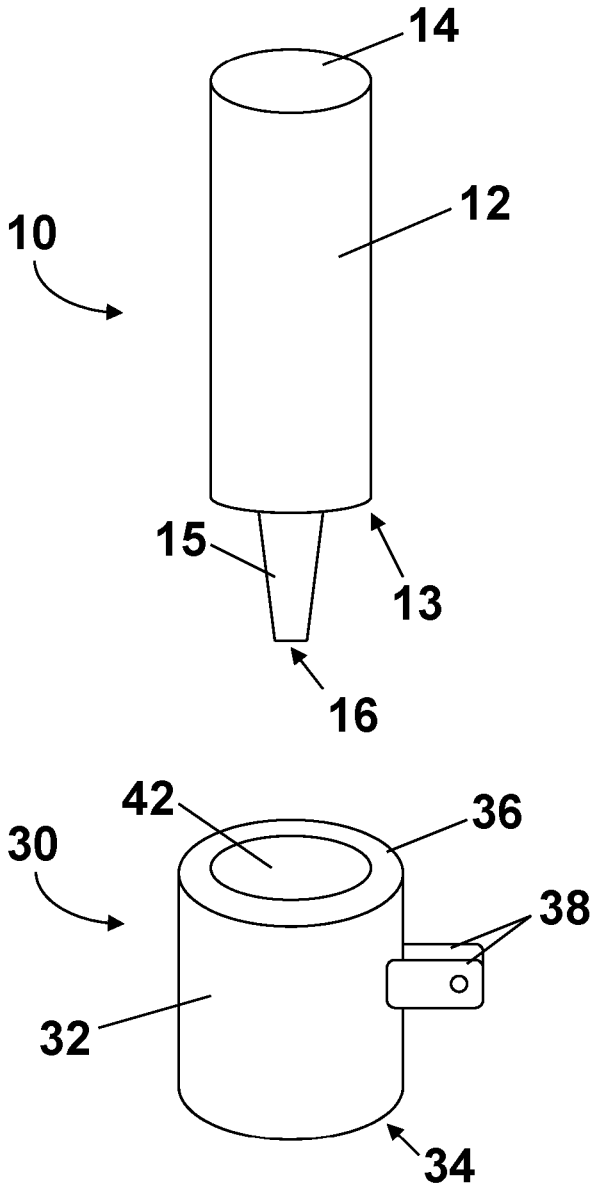
FIG. 1 is a perspective drawing of an embodiment of a warming device of the present invention and a container with a topical preparation therein prior to insertion of the container into the warming device.

FIG. 1 is a perspective drawing of an embodiment of a warming device of the present invention and a container with a topical preparation therein prior to insertion of the container into the warming device. The figure shows container 10 for holding a topical preparation, and warming device 30. Container 10 has a main body 12 with a proximal end 14, a distal end 13, and a dispensing tip 15 with a container dispensing orifice 16. Warming device 30, shown in FIG. 1, as well as FIGS. 3 through 7, has a housing 32 with a top surface 36, a bottom surface 34, a top surface orifice 42, a bottom surface orifice 46, and a cover 48. Electrical prongs 38 are connected to internal heating element 52 via an electrical circuit.

Main body 12 of container 10 as shown in FIG. 1 is generally tubular in shape, with a generally oval cross-section. It is to be understood that the cross-section of main body 12 may be circular, triangular, rectangular, a square, a polygon, or other odd shapes such as star-shaped. Dispensing tip 15 as shown in FIG. 1, is generally conical in shape, with a taper from distal end 13 (larger size) to container dispensing orifice 16 (smaller size). Optionally, dispensing tip 15 has a reverse taper from distal end 13 (smaller size) to container dispensing orifice 16 (larger size), is not tapered, or has combinations thereof. Though dispensing tip 15 is shown in FIG. 1 as generally tubular in shape with a generally oval cross-section, it is to be understood that the cross-section of dispensing tip 15 may be circular, triangular, rectangular, a square, a polygon, or other odd shapes such as star-shaped. Dispensing tip 15 may be an integral part of container 10. Optionally, dispensing tip 15 may be threaded on one end so as to be mounted on distal end 13 of container 10.

In general, container 10, which may also be referred to as a bottle, is formed of a material capable of being deformed by squeezing so as to move topical preparation from main body 12 of container 10 to dispensing tip 15. The materials for container 10 include, but are not limited to, polyethylene terephthalate (PET), high-density polyethylene (HDPE), polyvinyl chloride (PVC), low-density polyethylene (LDPE), polypropylene (PP), or made from a combination of two or more layers of these or other plastics.

Figure 5:
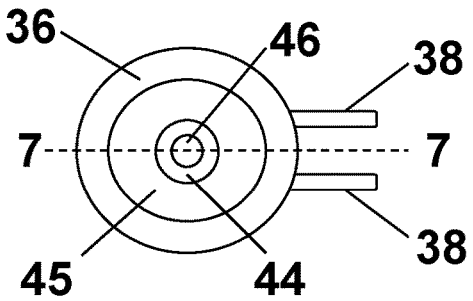
FIG. 5 is a top view of the device of FIG. 3.
Figure 6:
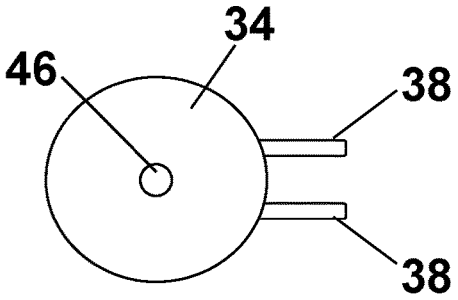
FIG. 6 is a bottom view of the device of FIG. 3.

FIG. 5 is a top view of warming device 30. In this view, top surface orifice 42 and a bottom surface orifice 46 are shown, as well as optional shoulder 45. Shoulder 45 may be used to seat distal end 13 of container 10 in warming device 30.

Figure 7:
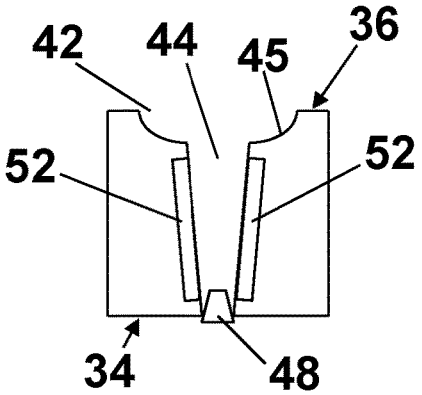
FIG. 7 is a vertical sectional view of FIG. 5 along the 7-7 plane.

FIG. 7 is a vertical sectional view warming device 30 along the 7-7 plane of FIG. 5. In this view, heating elements 52 are shown in the channel 44 which runs between optional shoulder 45 in top surface orifice 42 and bottom surface orifice 46. Channel 44 as shown in FIG. 7, is generally tubular in shape, with a taper from optional shoulder 45 (larger size) to bottom surface orifice 46 (smaller size). Optionally, channel 44 has a reverse taper from optional shoulder 45 (smaller size) to bottom surface orifice 46 (larger size), is not tapered, or has combinations thereof. Though channel 44 is shown in FIG. 7 as generally tubular in shape with a generally oval cross-section, it is to be understood that the cross-section of channel 44 may be circular, triangular, rectangular, a square, a polygon, or other odd shapes such as star-shaped.

Internal heating element 52 of warming device 30 is an electric heater that functions via the process of electric heating. Electric heating is any process in which electrical energy is converted to heat. The heating element inside every electric heater is simply an electrical resistor, and works on the principle of Joule heating: an electric current through a resistor converts electrical energy into heat energy. Most heating elements use Nichrome 80/20 (80% nickel, 20% chromium) wire, ribbon, or strip. Nichrome 80/20 is an ideal material, because it has relatively high resistance and forms an adherent layer of chromium oxide when it is heated for the first time. Material beneath this layer will not oxidize, preventing the wire from breaking or burning out.

FIGS. 1 through 6 show electrical prongs 38. Electrical prongs 38 are connected to internal heating element 52 of warming device 30. Though the connection is not shown in FIGS. 1 through 7, it is to be understood that a simple circuit connects prongs 38 to internal heating element 52. The circuit has prongs 38, lead wires, heating element 52, and optionally an on/off switch, a thermal limit switch, a fuse, a thermostat, and a pilot light. Optionally, the pilot light is mounted on the housing 32 of warming device 30 so that the consumer is aware when the electrical circuit is active. Optionally, a control light, mounted on the housing 32 of warming device 30, may be used to alert the consumer when the topical preparation in dispensing tip 15 has reached application temperature.

Figure 2:
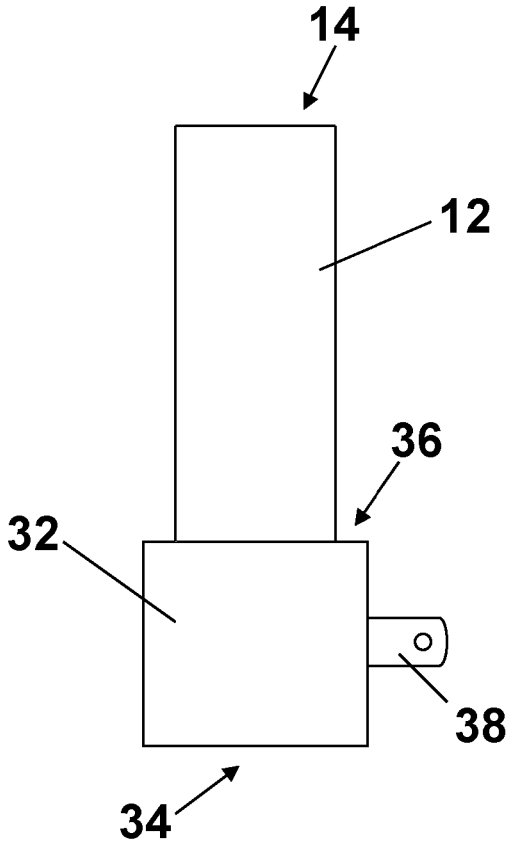
FIG. 2 is a side view of the warming device after insertion of the topical preparation container.
Figure 3:
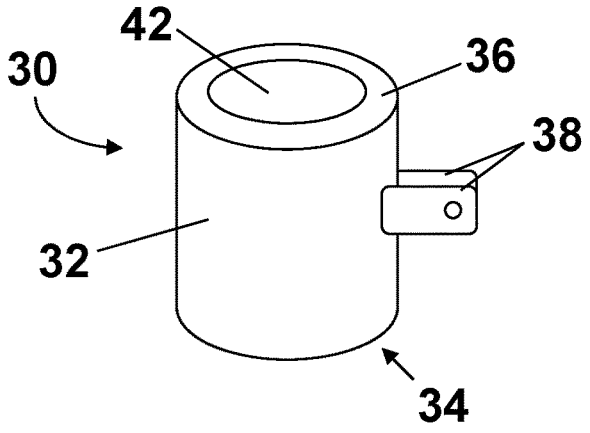
FIG. 3 is a perspective drawing of an embodiment of a warming device of the present invention.
Figure 4:
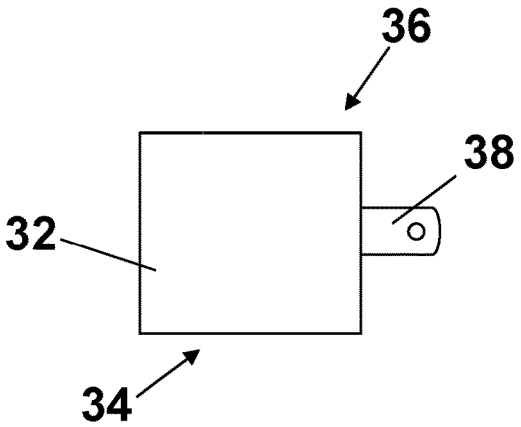
FIG. 4 is a side view of the device of FIG. 3.

FIG. 2 is a side view of an embodiment of warming device 30 after insertion of topical preparation container 10. In this embodiment, distal end 13 of container 10 is seated in shoulder 45 of warming device 30. Dispensing tip 15 of container 10 is disposed in channel 44 of warming device 30 in contact with internal heating element 52. Optionally, the geometry of dispensing tip 15 is matched to that of channel 44 so that dispensing tip 15 is in intimate contact with heating element 52.

As mentioned above, only dispensing tip 15 of container 10 is disposed in channel 44 of warming device 30. Therefore, only a portion of the contents of the container are heated. This allows the consumer to warm only a portion of topical preparation prior to use. This results in several advantages over prior art devices that warm the entire container. In the prior art devices, the consumer must wait for the entire contents to be warmed before use. In addition, there is a waste of energy if the entire contents are warmed and only a small portion of the container is used. Also, if the consumer plans to use the topical preparations intermittently, then the consumer must either keep the container continually in the warming device (wasting energy), or spend time waiting for the entire contents of the container to re-warm each time they wish to use a warm preparation. In some cases, the repeated heating and cooling of the topical preparation results in the degradation of the lotion by chemical (such as oxidation) or physical (such as phase separation). The dispensing tip 15 also completely physically isolates topical preparation from the heater in contrast to known warmers that heat a certain dose by passing it through a heat exchanger.

In use, the consumer would assemble the container 10 and warming device 30 as shown in FIG. 2, with distal end 13 of container 10 seated in shoulder 45 of warming device 30. Dispensing tip 15 of container 10 is disposed in channel 44 of warming device 30 in contact with internal heating element 52. Container 10 may be deformed (squeezed) to move topical preparation from main body 12 of container 10 to dispensing tip 15. Next, the assembly is plugged into a power source via electrical prongs 38. In one embodiment, the heating elements 52 of warming device 30 are immediately energized to begin heating topical preparation in dispensing tip 15. Optionally, consumer displaces an on/off switch to energize the heating elements 52 of warming device 30 to begin heating topical preparation in dispensing tip 15.

The time for topical preparation in dispensing tip 15 to reach the desired use temperature is less than 20 minutes, or less than 10 minutes, or less than 5 minutes, or less than 3 minutes, or less than 1 minute.

Once topical preparation in dispensing tip 15 has reached the desired temperature, consumer removes the container/warming device assembly from power source. Optionally, a control light, mounted on the housing 32 of warming device 30, may be used to alert the consumer when the topical preparation in dispensing tip 15 has reached application temperature. Consumer then removes cover 48 from warming device 30, and removes topical preparation from dispensing tip 15 for use. This may be accomplished by the consumer squeezing deformable container 10 to move unheated topical preparation from main body 12 of container 10 to dispensing tip 15, displacing the heated topical preparation from dispensing tip 15 to the consumer's hand, for example.

Figure 8A:
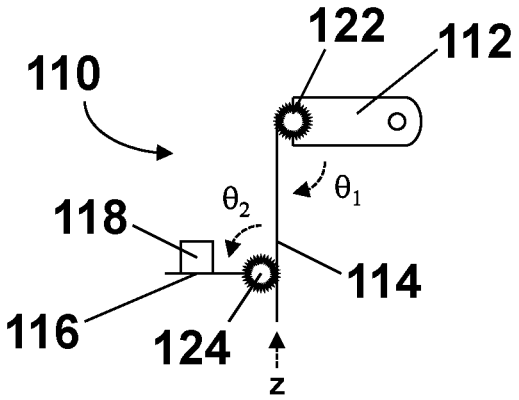
FIG. 8*a* is a side view of an embodiment of a sealing mechanism for use in the warming device of the present invention in a first position.
Figure 8B:
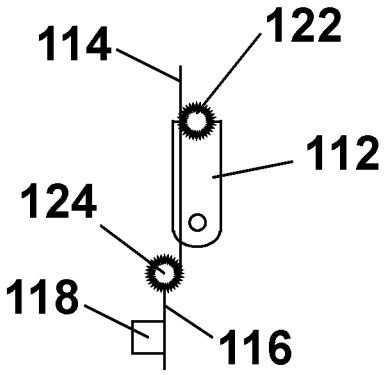
FIG. 8*b* is a side view of the sealing mechanism of FIG. 8*a* in a second position.

In some embodiments, a sealing mechanism is used in conjunction with the electrical prongs. FIGS. 8*a* and 8*b* is a side view of an embodiment of a sealing mechanism for use in warming device 30 of the present invention. The figures show sealing device 110 with electrical prongs 112, first pinion 122, second pinion 124, rack 114, shim 116, and cover 118. First pinion 122 is attached to electrical prongs 112, while shim 116 is attached to second pinion 124. Cover 118 is attached to shim 116.

Pinions 122 and 124, along with rack 114, are a type of "rack and pinion". A "rack and pinion" is a type of linear actuator that comprises gears which convert rotational motion into linear motion. A circular gear called "the pinion" engages teeth on a linear "gear" bar called "the rack"; rotational motion applied to the pinion causes the rack to move, thereby translating the rotational motion of the pinion into the linear motion of the rack.

In the case of sealing device 110, when electrical prongs 112, and attached pinion 122, are displaced along rotational axis $\theta_1$, rack 114 is displaced along linear axis z. As rack 114 is displaced along linear axis z, pinion 124 and attached shim 116 are displaced along rotational axis $\theta_2$.

FIG. 8*a* shows sealing device 110 in its first position, while FIG. 8*b* shows sealing device 110 in its second position. The gear ratios of pinions 122 and 124 are designed so that the angle of rotation along rotation axis $\theta_1$ is equal to the angle of rotation along rotation axis $\theta_2$. Optionally, the angle of rotation along rotation axis $\theta 0_1$ is greater than or less than the angle of rotation along rotation axis $\theta_2$.

Figure 9A:
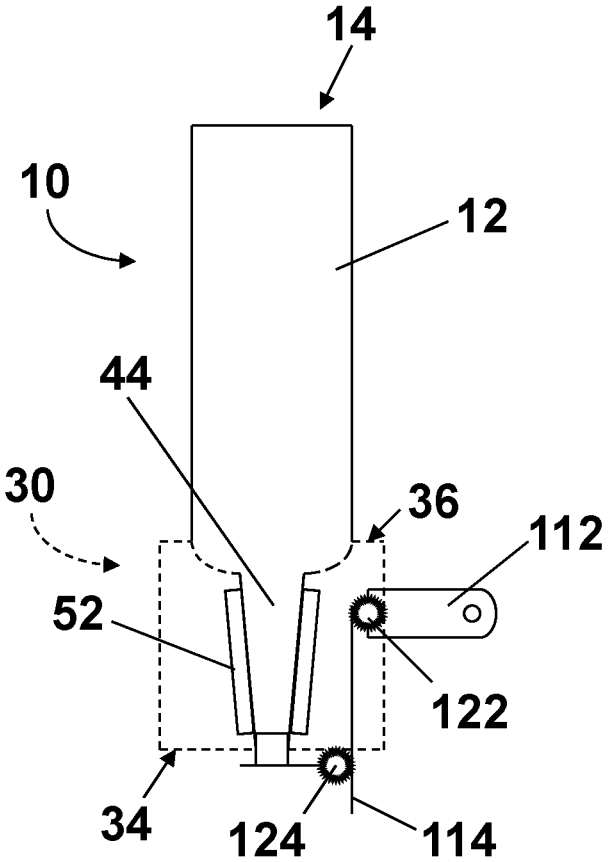
FIG. 9*a* is a side view of the sealing mechanism of FIG. 8*a* in conjunction with the warming device of the present invention in a first position.
Figure 9B:
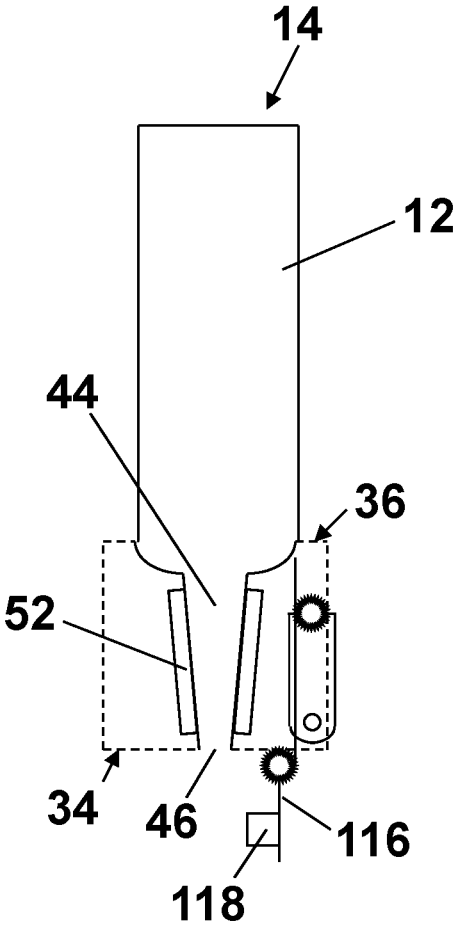
FIG. 9*b* is a side view of the sealing mechanism of FIG. 9*a* in a second position.

FIGS. 9*a* and 9*b* are side views of one embodiment of sealing device 110 in conjunction with warming device 30. When sealing device 110 is in first position (as in FIG. 9*a*), cover 118 is positioned so as to prevent flow of topical preparation out of bottom surface orifice 46 of warming device 30. When sealing device 110 is in second position (as in FIG. 9*b*), cover 118 is positioned so as to allow flow of topical preparation out of bottom surface orifice 46 of warming device 30.

In use, the consumer would assemble the container 10 and warming device 30 as described above, with sealing device 110 is its first position. Container 10 may be deformed (squeezed) to move topical preparation from main body 12 of container 10 to dispensing tip 15. The assembly is then plugged into a power source via electrical prongs 38. In one embodiment, the heating elements 52 of warming device 30 are immediately energized to begin heating topical preparation in dispensing tip 15. Optionally, consumer displaces an on/off switch to energize the heating elements 52 of warming device 30 to begin heating topical preparation in dispensing tip 15.

The time for topical preparation in dispensing tip 15 to reach the desired use temperature is less than 20 minutes, or less than 10 minutes, or less than 5 minutes, or less than 3 minutes, or less than 1 minute.

Once topical preparation in dispensing tip 15 has reached the desired temperature, consumer removes the container/warming device assembly from power source. Optionally, a control light, mounted on the housing 32 of warming device 30, may be used to alert the consumer when the topical preparation in dispensing tip 15 has reached application temperature. Consumer then displaces electrical prongs 112, and attached pinion 122, along rotational axis $\theta_1$, removing cover 118 from bottom surface orifice 46 of warming device 30. This allows flow of topical preparation from dispensing tip 15 of warming device 30. Topical preparation may be removed by the consumer squeezing deformable container 10 to move unheated topical preparation from main body 12 of container 10 to dispensing tip 15, displacing the heated topical preparation from dispensing tip 15 to the consumer's hand, for example.

The advantage of sealing device 110 is when prongs 112 are in the first position, warming device 30, is sealed preventing accidental discharge of heated topical preparation from the device. Accidental discharge may result if the consumer inadvertently squeezes deformable container 10 when removing it from power source, for example.

The specification and embodiments above are presented to aid in the complete and non-limiting understanding of the invention disclosed herein. Since many variations and embodiments of the invention can be made without departing from its spirit and scope, the invention resides in the claims hereinafter appended.

What is claimed is:

1. A warming device comprising:

(a) a housing having a top surface, a bottom surface, a first side extending from the top surface to the bottom surface and a receptacle disposed therein and extending from the top surface to the bottom surface, the receptacle having a top surface orifice and a bottom surface orifice;

(b) heating elements disposed within the housing and substantially surrounding the receptacle;

(c) an electrical connection in the form of a plurality of prongs associated with the first side surface for selective coupling to an external electrical power source, the electrical connection being pivotable between a first position extending substantially perpendicular from the first side for insertion into an electrical socket and a second position, substantially parallel to the first side; and (d) a bottom surface orifice cover mechanically connected to the electrical connection, and movable between a first position, corresponding to the first position of the electrical connection, wherein the cover occludes the bottom surface orifice and a second position, corresponding to the second position of the electrical connection, wherein the cover is displaced from the bottom surface orifice.

2. The warming device of claim 1, wherein the receptacle provides a generally conical void.

3. The warming device of claim 1, further comprising a light mounted on the housing arranged and configured to provide information to a user.

4. The warming device of claim 1, further comprising a power switch to energize the heating elements.

5. A kit comprising:

(a) a warming device comprising:

(i) a housing having a top surface, a bottom surface, a first side extending from the top surface to the bottom surface and a receptacle disposed therein and extending from the top surface to the bottom surface, the receptacle having a top surface orifice and a bottom surface orifice;

(ii) heating elements disposed within the housing and substantially surrounding the receptacle;

(iii) an electrical connection in the form of a plurality of prongs associated with the first side surface for selective coupling to an external electrical power source, the electrical connection being pivotable between a first position extending substantially perpendicular from the first side for insertion into an electrical socket and a second position, substantially parallel to the first side; and (iv) a bottom surface orifice cover mechanically connected to the electrical connection, and movable between a first position, corresponding to the first position of the electrical connection, wherein the cover occludes the bottom surface orifice and a second position, corresponding to the second position of the electrical connection, wherein the cover is displaced from the bottom surface orifice; and (b) a container comprising:

(i) a main body comprising a reservoir for a topical preparation; and (ii) a dispensing tip arranged and configured for engaging the receptacle.

6. The kit of claim 5 wherein the receptacle provides a generally conical void, and the dispensing tip is generally conical.

7. The kit of claim 5 further comprising a light mounted on the housing arranged and configured to provide information to a user.

8. The kit of claim 5 further comprising a power switch to energize the heating elements.

9. A method of heating a topical preparation contained in a reservoir of a container having a dispensing tip employing a warming device having a housing containing an electrical heater operatively connected to an electrical connection, the method comprising the steps of:

(a) inserting the dispensing tip of the container into a receptacle disposed in the housing of the warming device, the receptacle extending from a top surface of the housing to the bottom surface thereof and having a bottom surface orifice arranged and configured to permit the dispensing of an amount of the topical preparation from the dispensing tip of the container;

(b) inserting an electrical connection in the form of a plurality of prongs into an external electrical power source, the electrical connection being pivotable between a first position extending substantially perpendicular from a first side of the housing for insertion into an electrical socket and a second position, substantially parallel to the first side of the housing, whereby the electrical heater warms the topical preparation associated with the dispensing tip of the container;

(c) removing the electrical connection of the warming device from the electrical socket, and pivoting the electrical connection to the second position, wherein a cover that is mechanically connected to the electrical connection, and movable between a first position, corresponding to the first position of the electrical connection and occluding the bottom surface orifice, moves to a second position, displaced from the bottom surface orifice; and (d) dispensing a desired amount of warmed topical preparation from the dispensing tip of the container.

10. The method of claim 9, wherein the electrical heater warms the topical preparation associated with the dispensing tip of the container for less than 20 minutes.

11. The method of claim 10, wherein the electrical heater warms the topical preparation associated with the dispensing tip of the container for less than 5 minutes.

* * * * *